US006266876B1

(12) United States Patent
Lawson et al.

(10) Patent No.: US 6,266,876 B1
(45) Date of Patent: Jul. 31, 2001

(54) METHOD OF GAP FILLING A CONDUCTIVE SLIP RING

(75) Inventors: Glenn E. Lawson; Stephen R. Cole, both of Blacksburg; Anthony L. Bowman, Penbroke; Michael J. Day, Blacksburg, all of VA (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/438,403

(22) Filed: Nov. 12, 1999

(51) Int. Cl.[7] ..... H01R 43/00

(52) U.S. Cl. ..... 29/885; 29/597; 264/258; 156/293

(58) Field of Search ..... 29/597, 525, 733, 29/596, 598; 264/258, 277; 310/232, 235; 156/293, 313

(56) References Cited

U.S. PATENT DOCUMENTS 3,085,951 * 4/1963 Bentley et al. ..... 29/597
3,280,354 * 10/1966 Unger ..... 29/597
3,398,387 * 8/1968 Wendell ..... 29/597
3,785,049 * 1/1974 Kanamaru et al. ..... 29/629
4,380,446 * 4/1983 Dickson et al. ..... 493/11
4,549,923 * 10/1985 Tachibana et al. ..... 156/423
4,782,580 * 11/1988 Cacioppo et al. ..... 29/597
4,871,935 * 10/1989 Sweet et al. ..... 310/232
5,054,189 10/1991 Bowman ..... 29/597
5,224,138 6/1993 Hirao et al. ..... 378/15
5,525,852 * 6/1996 Fanning et al. ..... 310/217
5,734,218 * 3/1998 Crockett et al. ..... 310/232
5,745,976 * 5/1998 Crockett et al. ..... 29/597
5,901,429 * 5/1999 Crockett ..... 29/597
5,958,533 * 9/1999 Paasonen et al. ..... 428/36.5

* cited by examiner

*Primary Examiner*—Carl J. Arbes
*Assistant Examiner*—Minh Trinh
(74) *Attorney, Agent, or Firm*—Lowe Hauptman; Gilman & Berner, LLP

(57) ABSTRACT

In a wrapped ring manufacturing process for slip ring assemblies, the assembly is heated to expand a gap between ends of the slip ring. A conductive material is then used to fill the expanded gap, to assure compression of the conductive material and to eliminate cracks therein. The filled gap is electroplated with a precious metal to form a layer of material of uniform hardness, wear resistance, electrical conductivity and environmental resistance around the entire perimeter of the slip ring.

10 Claims, 1 Drawing Sheet

METHOD OF GAP FILLING A CONDUCTIVE SLIP RING

TECHNICAL FIELD

This invention relates generally to methods of manufacturing electrical slip ring assemblies. More particularly, the inventive method relates to construction of a slip ring assembly base having a plurality of conductive rings thereabout, and more specifically to an improvement in a method for such manufacture known in the art as wrapped ring technology.

BACKGROUND ART

Electrical slip rings are well known in the art for communicating electrical signals between structural members which are rotatable relative to each other.

A useful method of manufacturing large diameter electrical slip ring bases, commonly referred to as wrapped ring technology, is disclosed in Bowman et al. U.S. Pat. No. 5,054,189, the contents of which are hereby incorporated by reference. As described therein, a slip ring assembly may include an annular base member having a plurality of conductive rings surrounding an outer circumferential face thereof, and a series of electrically conductive brushes arranged on another structural member, wherein one of the annular base member and the structural member is relatively rotatable about the other. In such a configuration, the conductive rings are contacted by the conductive brushes to form a plurality of electrical connections between the two structural members.

As disclosed in the prior patent, a method of manufacture of the slip ring base may include forming a series of annular grooves in the circumferential outer face of an annular base, for receiving rings of electrically conductive material. Linear conductive material is cut to lengths, forming strips each of which substantially corresponds to the circumference of the outer face of the annular base, to form a plurality of electrically conductive rings. First ends of respective rings are anchored at respective points on respective grooves, and the respective rings are pressed into engagement within the respective grooves (e.g., by progressively exerting a rolling pressure along the lengths of the rings around the circumference of the outer face). The other ends of the respective rings are secured to the slip ring base. In one application of the wrapped ring technology, the conductive strips are pre plated with a conductive material, such as silver.

One advantage of the wrapped ring technology over known solid ring technologies is that, in the wrapped ring technology, inexpensive strip-form material can be used, instead of the more expensive solid rings.

However, while slip ring assemblies manufactured by the wrapped ring technology described above are useful, such assemblies suffer from the following deficiencies.

In the known art, the accumulation of manufacturing tolerances results in an inevitable gap between the ends of the conductive slip rings.

A small gap between the ring ends is, indeed, generally desirable to assure that the ring ends do not contact during the rolling operation and prevent the ring from properly sitting in the groove. However, the gap resulting from the known manufacturing process is a physical discontinuity having technical consequences on durability of the brushes, on the quality of electrical connection between the conductive rings and the brushes, and on transmission of signals therebetween.

A problem arising from the existence of the gap is the accumulation therein of wear debris, whether from the brushes, rings, or other materials. Once sufficient wear debris accumulates in the gap between the ring ends, such debris can cause an increase in electrical resistance between the brush and the slip ring. Increased contact resistance may occur when the debris is dislodged onto the ring contact surface, for example. Increased contact resistance may introduce electrical noise into signals transmitted between the slip rings and the brushes, or may attenuate signal transmission therebetween.

In one embodiment of a wrapped slip ring described at FIG. 11 in Hirao et al. U.S. Pat. No. 5,224,138, beginning and end portions of a metal tape 264 forming a slip ring are coupled by solder 272. While such an approach may appear to overcome the above described technical problems, in fact the solution creates an additional technical problem of solder smearing.

Solder used in the manner shown in the prior art will smear onto the adjacent ring surface and, as solder is not a precious metal, will oxidize with undesirable characteristics. An accumulation of the smeared oxides will cause increased electrical noise, significantly degrading the ability of the ring to function with low voltage, low current signals. While accumulation of oxide on a slip ring supplying power to CT scanner X-ray tubes may be acceptable, such accumulation is unacceptable for slip rings operating at low level signal voltages.

Thus, use of solder between ring ends is an unacceptable solution which replaces one noise problem in signal transmission by another, similar, problem.

Moreover, solder will wear at a faster rate than the silver. Accordingly, after extended operation, a rut will develop in the solder.

The potential for these or other possible technical problems is one of the chief drawbacks to the wrapped ring technology relative to solid ring technologies. However, as noted above, the wrapped ring technology has an economic advantage over solid ring technologies. This economic advantage becomes more pronounced as the diameter of the device increases.

There is thus a need in the prior art for an improved method of manufacture of slip ring assemblies which maintains the economic advantage of wrapped ring technologies over solid ring technologies, but which overcomes the known deficiencies of known wrapped ring technologies.

DISCLOSURE OF INVENTION

It is accordingly an object of the present invention to overcome the deficiencies of the prior art.

More specifically, it is an object of the invention to provide an improved method for manufacture of slip ring assemblies, which maintains the economic advantage of wrapped ring technology over solid ring technology, while overcoming the disadvantages of known wrapped ring technologies.

It is a particular object of the invention to provide an improved wrapped ring technology for manufacture of slip ring assemblies.

It is a more specific object of the invention to provide an improved method for manufacture of slip ring bases overcoming prior art problems arising from existence of gaps between ends of slip rings.

It is still a more particular object of the invention to provide an improved method for manufacture of a slip ring base by filling a gap between ends of slip rings with a solid conductive material.

It is yet a more specific object of the invention to provide an improved method for manufacture of a slip ring base, wherein the assembly is heated to a temperature chosen in order to reduce tensile forces acting a filler material added to a gap between ends of the ring.

It is still a more specific object of the invention to provide an improved method for manufacture of a slip ring base, wherein the assembly is heated to a temperature chosen in order to provide compressive forces on a filler material added to a gap between ends of the ring.

It is another object of the invention to provide an improved method for manufacture of a slip ring base, wherein a filler material is added to the gap between the ends of a ring and the surfaces of the ring and the gap are plated with a precious metal.

It is yet another object of the invention to provide an improved method for manufacture of a slip ring base wherein a mismatch in thermal expansion characteristics of the ring material and base material is reduced.

It is still a further object of the invention to provide an improved method for manufacture of a slip ring base having slip rings plated with a particular conductor, wherein a filler material including a polymeric resin filled either with the same particular conductor or with a different conductor is added to the gap between the ends of a ring.

It is still another object of the invention to provide an improved method for manufacture of a slip ring base having slip rings plated with a precious metal, wherein a filler material including a polymeric resin filled with the same precious metal is added to the gap between the ends of a ring.

It is yet a further object of the invention to provide an improved method for manufacture of a slip ring base having plated slip rings wherein a filler material is added to the gap between the ends of a ring and the filled gap is over plated with the same material as the slip rings.

It should be appreciated, however, that while the disclosure refers specifically to addition to a gap of specific filler materials including epoxy resin and a noble metal, in the form of silver powder for example, the method described herein may be implemented with any materials now known or hereinafter developed which conform to the inventive concept and are suitable for the purposes herein set forth.

In accordance with the invention, there is thus generally provided a method of manufacturing a slip ring, including various combinations of steps such as wrapping conductive strips onto an insulating base, heating the assembly to a predetermined temperature thereby to expand the gap between the ends of the conductive strip and, while the gap is enlarged, filling the gap with a rigid conductive filler material. The above combination of steps may also include curing of the gap filler, to the extent necessary.

In accordance with a specific feature of the invention, in the heating step the assembly is heated to a temperature determined in accordance with a maximum temperature to which the slip ring will be exposed in its subsequent utilization.

In accordance with one aspect of the invention, in the heating step the assembly is heated to a temperature equal to or above a maximum temperature to which the slip ring will be exposed in its subsequent utilization.

In accordance with another aspect of the invention, in the heating step the assembly is heated to a temperature determined in accordance with a relation between the amount of mismatch between the thermal expansion characteristics of the ring material and the base material, on the one hand, and the maximum temperature to which the slip ring will be exposed in its subsequent utilization on the other hand.

In accordance with still another aspect of the invention, there is also implemented a step of electroplating over the filled gap with precious metal to form a layer of material of uniform hardness, wear resistance, electrical conductivity, and environmental resistance around the entire ring perimeter.

These and other objects, features and advantages of the present invention will become readily apparent to those skilled in the art from the following description and drawings, wherein there is shown and described a preferred embodiment of the invention, simply by way of illustration and not of limitation of one of the best modes (and alternative embodiments) suited to carry out the invention. The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWING

The accompanying drawings, incorporated into and forming a part of the specification, illustrate several aspects of a preferred embodiment of the present invention and, together with the description, serve to explain the principles of the invention. In the drawings.

BEST MODE FOR CARRYING OUT THE INVENTION

In order better to appreciate the present improvement, the following provides a description of a known method of manufacture of annular base members for slip ring assemblies, in accordance with the known wrapped ring technology.

Figure 1:
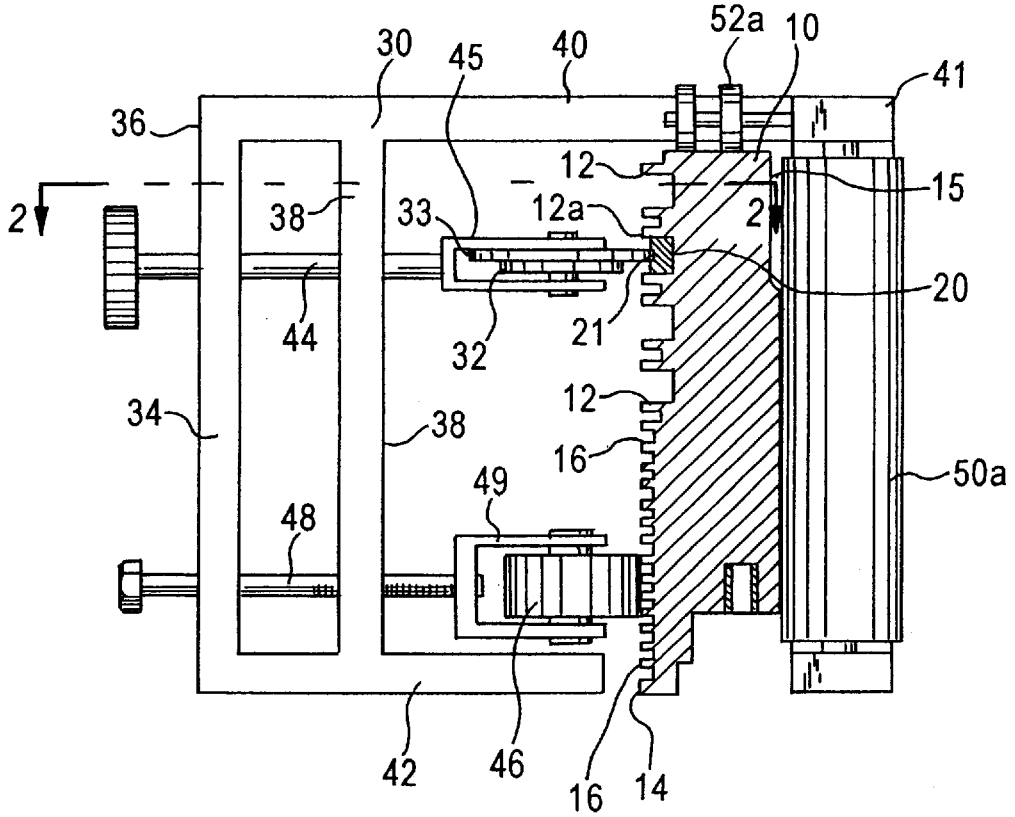
FIG. 1 (PRIOR ART)
FIG. 1 is a sectional view of a known annular slip ring base and an apparatus for manufacture thereof in accordance with the prior art.

Referring now to the drawings, in FIG. 1 there is shown a sectional view of a known annular base member 10 for an electrical slip ring assembly having a plurality of conductive rings placed therearound to carry both signal voltages and operating power. A series of relatively wider circumferential grooves 12 are provided in a portion of the outer circumferential surface 14 of base member 10. A series of relatively narrower circumferential grooves 16 may be machined in another portion of surface 14. As known in the art, the cross sectional shapes of grooves 12 and 16 may be selected to substantially conform to the shape of conductive strips to be mounted therein and the fiber brushes to be used in connection with those strips.

In FIG. 1, only one groove, designated by reference numeral 12*a,* is shown as having a conductive strip partially placed therein.

As known in the art, the ends of conductive strips placed in the grooves may be anchored by pins or bolts, which may be accessed from the inner circumference surface 15 of the annular base member through a series of openings, one of which may be provided for each groove.

Individual lengths of conductive material form conductive strips to be pressed into grooves 12. One such strip is shown at 20. Each conductive strip may be formed from a roll of conductive material such as brass or copper.

As seen in FIG. 1, strip 20 may have a groove 21 formed in the outer surface thereof, the groove 21 adapted to receive one of the series of brushes to be mounted on a rotating portion of the electrical slip ring assembly (not shown). The groove 21 may be pressed into the material by passing the material through a conventional rolling machine. The material may then be cut to length and mounting studs may be brazed to the ends of the ring. As known in the art, the rings formed by strips 20 may be plated with a layer of a conductive material. Silver is a known plating material used in the art.

In accordance with the known method, each conductive strip or ring, such as strip 20, is first fastened at one end thereof to one of a plurality of openings (not shown) provided in the grooves 12 of the annular base member. Conductive strip 20 is then press fit into groove 12*a* by means of rolling pressure exerted by fixture 30. Fixture 30 includes a pressure roller member 32 having an outer circumferential surface 33 shaped similarly to groove 21.

The fixture further includes a frame 34 having vertical support members 36 and 38 joined to horizontal support members 40 and 42. The vertical members have vertically elongated openings formed therein (not shown), for receiving an adjustable arm 44 which rotatably carries roller member 32 in a bifurcated end thereof, shown at 45. Arm 44 may be threadedly engaged with vertical member 38 to provide an adjustable lateral positioning of roller member 32, while the elongated shapes of the openings formed in vertical members 36 and 38 provide for proper vertical positioning of the pressure roller member. A support roller 46 may be rotatably mounted in a bifurcated end 49 of a second adjustable arm 48, which also extends through the openings in vertical members 36 and 38. Arm 48 may be threadedly adjusted to provide proper lateral support on the exterior circumferential surface and to ensure that roller member 32 is carried in a true horizontal position.

A pair of cylindrical support rollers provide proper positioning lateral pressure on the interior circumferential surface of annular base member 15. One such roller is shown at 50*a,* in front of horizontal support member 40. A second such roller may be provided behind support member 40. Thus, the rollers are rotatably mounted to an outer "T" shaped end 41 of support member 40. Support member 40 also has laterally attached thereto a pair of vertical support rollers to facilitate motion of the entire fixture 30 about the circumference of annular base member 10. One such vertical support roller is shown at 52*a.* positioned in front of support member 40. A second such roller may be provided behind support member 40.

In forming each of the conductive rings 20 into its respective groove 12*a,* one end is attached to the annular base member 10. At that point, fixture 30 is placed in engagement with annular base member 10 as shown in FIG. 1. Roller member 32 is adjusted to exert sufficient lateral pressure on strip 20 as to firmly press fit the strip into groove 12*a.* The entire fixture is then rotated about the circumference of annular base member. A significant circumferential force is exerted by the motion of roller member 32 so that the conductive strip may be slightly elongated in order to provide substantial abutment between the two ends of strip 20 when the entirety of strip 20 is in the groove 12*a.* At this point, as known in the art the second end of the strip may be fastened to the annular base member 10 through the opening therein provided in the groove.

Figure 2:
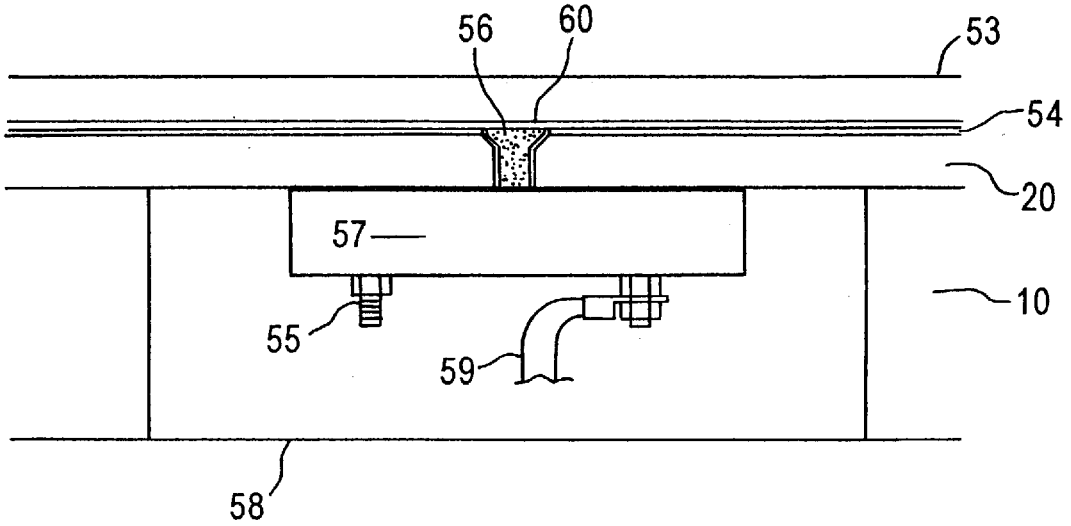
FIG. 2 is a sectional view taken along the line 2—2 of FIG. 1 illustrating an annular slip ring base manufactured in accordance with an embodiment of the inventive concept.

Referring now to FIG. 2, the presently preferred embodiment of the invention addresses the above noted difficulties which may arise when a gap exists between the two ends of the strip 20. In order better to illustrate the advantages arising from use of the inventive improvement, FIG. 2 is taken along line 2—2 in FIG. 1.

As shown in FIG. 2, grooves 12 are formed on the circumferential surface of annular base 10 between barriers 53. Conductive strips 20, which are plated with silver 54, are wrapped into the grooves 12 formed between barriers 53. As above noted, the strips are rolled into position and fastened by means of threaded fasteners, shown at 55 in FIG. 2. In a modification of the prior art approach described with reference to FIG. 1, and in order to bypass gap 56 formed between the ends of strip 20, a shunt 57 is provided in an access pocket 58 formed in base 10. Not shown are other threaded fasteners 55 which secure the strip 20 to base 10. Thus, threaded fasteners 55 fasten strip 20 to base 10 and to shunt 57. Lead wires 59 are terminated to the shunt-ring junction.

As hereinabove noted, accumulation of manufacturing tolerances results in existence of gap 56 between the ends of strip 20, and a number of problems arise as a consequence.

One such consequence is accelerated wear of the brush material riding over the discontinuity. Such wear is diminished by chaffering the sharp edges of the ring ends, as shown in FIG. 2.

The current invention represents a significant improvement over the prior art by enabling precious metal plating over the entire ring surface and over the gap. The precious metal plating addresses both the drawbacks associated with the presence of the gap, as well as the drawbacks associated with the prior art approach of filling a gap with solder.

It is noted that when solder is used, differences may arise because of the use of dissimilar conductive materials in the ring and in the gap. Such emf differences may adversely impact both the ring structure and its effectiveness for transmission of low level signal voltages and currents.

Moreover, because of differences in thermal expansion characteristics of the gap filling material and the ring (or ring plating material), stresses occur within the gap and at the boundaries between the gap filling material and the ring. Such stresses particularly occur when the slip ring assembly is used in its operating environment, and more particularly when the environmental temperature is raised. Such stresses may result in cracking, wearing, and further deposit of debris along the ring surface.

Applicants' novel approach to overcoming the above problem includes the step of heating the gap to a predetermined temperature prior to filling the gap. Thus, when operating environment of the ring is at or below that temperature, the gap will be in compression, thereby eliminating cracking of the gap filling materials as well as separation between the gap filling material and the ends of the slip rings.

Such thermal manipulation thus overcomes a significant problem of the prior art, arising from thermal stresses occurring at or adjacent to the gap.

It should be noted, however, that heating of the gap for curing the filling material of the gap need not necessarily be to the maximum operating temperature of the slip ring assembly. By careful thermal manipulation, use of an appropriate base material whose thermal expansion characteristics are closer to those of the ring and its plating material would result in occurrence of lower thermal stresses during heating of the slip ring assembly.

Thus, although heating to the maximal operating temperature will assure that, throughout the operational temperature range of the assembly, the gap and its filler material will be in compression and thus that stress cracks will be eliminated, the amount of thermal stress occurring at temperatures above the curing temperature may be reduced by use of the proper base material.

Accordingly, when an appropriate base material is used which has thermal expansion characteristics that are closer to those of the ring, the gap material may be cured at a temperature below the expected (or maximal) operating temperature of the assembly. That is, considering the difference between the thermal expansion characteristics of the base material and the same characteristics of the ring or its plating material, when the environmental temperature exceeds the cure temperature, the level of stress developed within the gap filling material, or between the gap filling material and the ring, is less for materials for which the difference is smaller than for materials for which the difference is larger. Thus, by using base materials having thermal characteristics which are a closer match for those of the ring or plating material, it becomes possible to reduce the thermal stress arising at raised temperatures. Accordingly, in accordance with the invention, cracks in the gap filling material may be eliminated or reduced even when curing takes place below the expected or maximal operating temperature of the assembly.

Accordingly, the present invention overcomes prior art problems arising from occurrences of gaps between the ends of the slip rings by filling the gap. However, unlike the prior art, the present invention does not use solder to fill the gap. Instead, the two major drawbacks of the wrapped ring are eliminated by using a gap filling material meeting the following criteria.

First, such a gap filling material must bond well to the ring ends. Otherwise, one larger gap could turn into two smaller gaps.

Moreover, the gap filling material must not wear at a significantly different rate than the surrounding ring material. Otherwise, the gap would develop into a physical discontinuity during operation.

Still further, the gap filling material must not smear non-conductive debris onto the surrounding ring; otherwise, it could cause undesirable variations in contact resistance.

Moreover, as above noted, although not a necessary condition, it is helpful if the gap base material has thermal expansion characteristics which match those of the surrounding ring.

In accordance with these criteria the presently preferred filler is a conductive epoxy, with sufficiently high loading (80% by weight) of silver powder, placed into the gap and cured at temperatures above the maximum use or storage temperature of the device. Although the presence of silver powder should be above approximately 70%, and preferably in the range of about 70% to about 90%, the preferable value of loading is approximately 80% silver by weight.

The filled gap 56 is then shaped by machining or filing, and the section of the ring containing the gap is over-plated at 60 with the same plating as the remainder of the ring. The function of the conductive epoxy is to fill the gap, to act as a suitable "starter" surface for electroplating, and to support the subsequent electroplated layer.

It is noted that commercially available conductive adhesives generally contain fillers that are quite conductive, but do not uniformly accept electroplate like wrought metals such as copper, brass or silver, and thus are unacceptable for the presently contemplated application. Indeed, the conductive fillers used in such adhesives are typically silver plated copper or other silver plated particles or flakes, as opposed to the presently preferred formulation, which contains solid silver powder at the above levels of loading by weight. Such loading is much higher than that commercially available in silver filled epoxies, and has been found to electroplate uniformly and at a similar rate to the adjoining ring material.

A second significant aspect of the invention is the use of the thermal expansion mismatch between the ring and epoxy base to exert compressive loads on the gap. Without tensile forces on the gap, the filler material would not crack or debond. The wrapped ring formed in accordance with the prior art is constructed such that, as the temperature increases the gap tends to open slightly.

Therefore, in accordance with the invention and the above disclosed considerations, the epoxy is filled into the gap and cured at temperatures equal to or above the maximum temperature at which the unit will operate. Thus, the gap (and the gap filler material) will always be in compression. For example, for CT scanners which operate at temperature ranges of −40° F. to +150° F., heating the gap to temperatures in the range of 145° F. to 165° F. have been successful. Heating should not be implemented to temperatures significantly above the normal temperature range of the device, as the annular base is designed for that range and, for temperatures significantly above the operating range, the base expands and the rings may snap. It is expected that heating to temperatures within approximately ±40° of the maximum temperature will be effective in implementing the inventive concept.

It is indeed possible that failures of earlier experiments with solder filled gaps, which showed poor performance because of smearing, and failures of filling materials using solders and conductive plastics due to cracking during thermal cycling or to an inability to be successfully electroplated, could be eliminated by use of the inventive technique.

A further significant aspect of the present invention is the overplating of the filled gap. This results in a uniform wear rate abound the perimeter of the ring with low electrical noise.

The following provides further description of the presently preferred specific epoxy composition to implement the invention and the underlying theoretical equations.

The conductive epoxy used was an in-house developed formulation consisting of 80% by weight silver powder and 20% by weight epoxy. The temporary internal experimental designation for this material is NB561-F006A. The formula is:

80 parts by weight (pbw) Silver powder 14 pbw Epoxy resin 6 pbw Hardener

The silver powder used was Aldrich 32,709-3 a 99+% silver powder with 5–8 micron average particle size. Although the preferred range of average particle size is about 5–8 microns, the size may be in the range of 0.25 micron to 25 microns, or more. That is, it is expected that silver powder or flake having average particle size in the range of 0.25 to 25 microns will work well in accordance with the invention. The epoxy resin used was Ciba-Geigy Araldite 502, a dibutyl phthalate plasticized diglycidal ether of bisphenol A (DGEBA) epoxy with an epoxy equivalent weight (EEW) of approximately 230. The Hardener was Henkel Versamid 125, a polyamide with an amine equivalent weight (AHEW) of approximately 345.

It is expected that other epoxy (such as undiluted DGEBA) and other hardener systems (such as other polyamides, polyamines, and mercaptans) would work well. Furthermore, it is expected that conductive polymers based on other polymers would also work well. Indeed, experiments were conducted with NB561-F006B which was 80% silver in 20% polyurethane. In these experiments, it was attempted to improve the ability of the gap filling material to flex and absorb the differential thermal expansions, but the material was not flexible enough to solve the problem (without the change in cure temperature). Therefore, use of the material was discontinued and experimentation continued with the NB561-F006A, with which more experimental history had been developed.

However, it is expected that polyurethane and other polymer matrix materials will work as well as the above described epoxy matrix.

In connection with the above described aspect of the invention wherein the filling material and the gap is cured above the use range of temperatures, applicants provide the following comments. It is recognized that it is not required to provide a theoretical basis for an invention. However, it is believed that the following comments will aid in appreciation of the invention.

The current configuration uses an epoxy base and copper strip rings. As the temperature changes the two materials expand (or contract) at different rates. The predictive equation for the relative mismatch of the base relative to the rings (i.e. the change in gap size) is $$\Delta=\pi D(CTE_{base}-CTE_{ring})(T_{use}-T\text{assembly})$$

Where: Δ is the change in the gap size; D is the average diameter of the copper ring; CTE is the coefficient of thermal expansion (CTE) of the ring or epoxy base; T is the temperature during assembly (when the ring and base are secured together) or use. In the current configuration, the ring is copper with a CTE of approximately $18\times10^{-6}$/° C. and the CTE of the epoxy base is $47\times10^{-6}$/° C. The diameter is approximately 38 inches, and the anticipated exposure temperature range is −40° C. to +66° C. (150° F.). Consequently, in the free state, the gap could increase in size by up to 0.152" at +150° F. At any temperature below the assembly temperature Δ is negative and the gap tends to compress.

When the ring is continuous (i.e. the gap filled), Δ represents the amount that the ring and gap filling are stretched. (Ignoring the small positive influence of the CTE of the filling material). Since the cross-sectional area (normal to the tensile force) is equal for the ring and gap filling, the deformation of the gap filling, and ring are $$\Delta=\Delta_{filling}+\Delta_{ring}$$

$$(\Delta_{filling}/L_{filling})E_{filling}=(\Delta_{ring}/L_{ring})E_{ring}$$

$$\Delta_{filling}=\Delta/(1+(L_{ring}/L_{filling})(E_{filling}/E_{ring}))$$

The stress on the filling—ring bond face is $$\sigma_{bond}=E_{filling}(\Delta_{filling}/L_{filling}).$$

Making an approximation (valid for large rings and rigid filling), $$\sigma_{bond}=E_{ring}(CTE_{base}-CTE_{ring})(T_{use}-T_{assembly})$$

Where: L is the length of the ring or filled gap; and E is the tensile modulus of the ring or filled gap. Using the lengths of 38π for the ring and 0.120" for the gap and modulus of 17,000,000 psi for the ring and 1,000,000 psi for the filling, the stress on the bond if assembled at 22° C. and subsequently exposed to 66° C. would be in excess of 20,000 psi. This is well beyond the bond strength of this, or similar filling materials. If a reasonable bond strength of 2000 psi were used as the design limit, then this configuration could accommodate a Δ of up to 0.014". This means that the cure temperature could actually be about 4° C. lower than the upper use temperature.

It is believed that the current process works by raising the temperature of the base prior to filling the gap. This effectively increases the "assembly" temperature and vastly reduces Δ, which in turn vastly decreases the bond stress (actually it is believed to decrease the maximum tensile stress on the bond). The stress is primarily dependent on the CTE and temperatures. If different materials were used, with better CTE match, then more temperature tolerance can be allowed.

However, in addition to the foregoing, it is noted that advantageous results may be achieved by a specific stud securing method.

The assumption of free or un-constrained expansion or contraction used in the above theory may be inapplicable to a specific configuration of the slip ring assembly, such as presently being implemented. In such a configuration, every ring is secured to the base by a plurality of studs. In such an assembly, at least four studs secure the ring to base. This constraint causes the gap to be smaller than theory predicts. The studs are secured to the base or to the shunt with nuts through clearance holes, and are torqued to specified levels. The friction developed under the nut head must thus be overcome before the ring can slip relative to the base. To prevent any motion, the total friction forces from the studs and nuts must be $$F=E_{ring}(\Delta_{ring}/L_{ring})A_{ring}.$$

In the current configuration the cross-sectional area of the rings (A) is 0.1064 square inches for power rings and 0.0136 square inches for signal rings. The corresponding frictional forces required are approximately 2,300 pounds and 300 pounds. It is estimated that in the current configuration the torque and nut size combinations provides up to 400–800 pounds of friction. This is adequate for small signal rings, but not enough to prevent the power rings from slipping.

To prevent the power rings from slipping the clearance between the stud and its hole in the base or shunt is filled with an epoxy. Therefore, in order to "slip" the thermal forces on the ring must not only overcome the bond strength of the filling and the frictional forces due to the stud-nut clamping, but also the stud must crush epoxy. The force required to crush the epoxy potting compound in the current configuration would be of the order of 2,000 to 4,000 pounds. This complementary securing method is required for large cross-sectional area rings, and is used on signal rings as "redundancy". The following table shows the relative forces contributed by each of the ring-end to ring-end securing mechanisms. The potting around the stud is the dominant mechanism.

| Ring type | Force due to filling to ring bond (lb.) | Force due to stud-nut friction (lb.) | For due to potting around stud (lb.) | Force required to prevent slip (lb.) |
|---|---|---|---|---|
| Signal | 27 | 400 | 1,920 | 300 |
| Power | 212 | 800 | 4,000 | 2,300 |

Because of the process variations and the particular configuration of the power ring, slight temperature variations in the process oven has on occasion caused the rings to slip after the filling had cured. This slight slip caused enough stress on the filled gap to break the bond to the ring (resulting in crack). Potting the studs eliminates this problem. Another problem eliminated by potting the studs is that if the ring slips and the gap opens prior to filling, then, upon return to room temperature the ring (with an oversized gap) is loose on the base.

The foregoing description of the preferred embodiment of the invention has been presented for purposes of illustration and description. It is not intended to be exhaustive or to limit the invention to the precise forms disclosed, since many modifications or variations thereof are possible in light of the above teaching.

Any such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated therefor. It is intended that the scope of the invention be defined by the claims appended hereto, when interpreted in accordance with the full breadth to which they are legally and equitably entitled.

What is claimed is:

1. In a wrapped ring method for manufacturing an annular base for a slip ring assembly, wherein strips of conductive material are wrapped onto an insulating base, the improvement comprising heating at least ends of a strip of conductive material to a temperature level corresponding to a maximum operating temperature for the slip ring formed of the strip, whereby a gap between ends of the strip of conductive material is thermally expanded; and when the gap is thermally expanded, filling the gap with a rigid conductive material.

2. The method of claim 1, further comprising the step of plating over the filled gap with a conductive material to form a uniform layer of conductive material around an entire perimeter of a slip ring formed by the strip.

3. The method of claim 2, wherein said step of plating over comprises plating over the filled gap with a same conductive material as used for plating a surface of the slip ring.

4. The method of claim 2 wherein said step of plating over comprises plating over the filled gap with a precious metal.

5. In a wrapped ring method for manufacturing an annular base for a slip ring assembly, wherein strips of conductive material are wrapped onto an insulating base, the improvement comprising heating at least ends of a strip of conductive material to a temperature level chosen to reduce tensile forces acting on a filler material added to a gap between ends of the strip of conductive material, wherein the gap is thermally expanded by the heating step; and filling the gap with a rigid conductive filler material.

6. The method of claim 5, wherein said step of heating comprises heating at least the ends of the strip to a temperature chosen in order to provide compressive forces on the filler material.

7. The method of claim 5, wherein said step of heating comprises heating at least the ends of the strip to a temperature determined in accordance with a maximum temperature to which the slip ring will be exposed in its subsequent utilization.

8. The method of claim 7, wherein said step of heating comprises heating at least the ends of the strip to a temperature determined in accordance with a relation between an amount of mismatch between thermal expansion characteristics of the strip of conductive material, the annular base and the filler material and the maximum temperature to which the slip ring will be exposed in its subsequent utilization.

9. The method of claim 5, wherein said step of filling the gap comprises filling the gap with a filling material which electroplates uniformly over the gap and which electroplates uniformly relative to an adjoining ring material.

10. The method of claim 5, wherein said step of filling the gap comprises filling the gap with a filling material which includes solid silver filler in the range of 70% to 90% by weight.

* * * * *